US008061334B2

(12) United States Patent
Eitel et al.

(10) Patent No.: US 8,061,334 B2
(45) Date of Patent: Nov. 22, 2011

(54) DEVICE FOR RECYCLING AND COOLING EXHAUST GAS FOR AN INTERNAL COMBUSTION ENGINE

(75) Inventors: Jochen Eitel, Bissingen (DE); Markus Flik, Gerlingen (DE); Peter Geskes, Ostfildern (DE); Thomas Heckenberger, Leinfelden-Echterdingen (DE); Dieter Heinle, Pluederhausen (DE); Jens Ruckwied, Stuttgart (DE); Andreas Thumm, Ilsfeld (DE)

(73) Assignee: Behr GmbH & Co. KG, Stuttgart (DE)

( * ) Notice: Subject to any disclaimer, the term of this patent is extended or adjusted under 35 U.S.C. 154(b) by 840 days.

(21) Appl. No.: 11/917,913

(22) PCT Filed: Jun. 20, 2006

(86) PCT No.: PCT/EP2006/005908

§ 371 (c)(1),
(2), (4) Date: Mar. 10, 2008

(87) PCT Pub. No.: WO2006/136372

PCT Pub. Date: Dec. 28, 2006

(65) Prior Publication Data

US 2009/0044789 A1 Feb. 19, 2009

(30) Foreign Application Priority Data

Jun. 24, 2005 (DE) ..... 10 2005 029 322

(51) Int. Cl.
*F02M 25/07* (2006.01)
*F02B 47/08* (2006.01)
*F02B 33/44* (2006.01)

(52) U.S. Cl. ..... 123/568.12; 60/605.2

(58) Field of Classification Search ..... 123/563, 123/568.11, 568.12, 568.2; 60/599, 602, 60/605.2, 612

See application file for complete search history.

(56) References Cited

U.S. PATENT DOCUMENTS

| | | | | |
|---|---|---|---|---|
| 5,607,010 | A | 3/1997 | Schönfeld et al. | |
| 6,213,105 | B1 | 4/2001 | Banzhaf et al. | |
| 6,244,256 | B1 | 6/2001 | Wall et al. | |
| 6,269,870 | B1 | 8/2001 | Banzhaf et al. | |
| 6,470,682 | B2 * | 10/2002 | Gray, Jr. | 60/605.2 |
| 6,675,782 | B1 * | 1/2004 | Persson | 123/568.12 |
| 6,688,280 | B2 * | 2/2004 | Weber et al. | 60/612 |
| 6,935,319 | B2 * | 8/2005 | Aupperle et al. | 123/568.12 |
| 6,978,772 | B1 * | 12/2005 | Dorn et al. | 123/568.12 |
| 7,032,577 | B2 | 4/2006 | Rosin et al. | |
| 7,168,419 | B2 | 1/2007 | Rosin et al. | |
| 7,287,378 | B2 * | 10/2007 | Chen et al. | 60/605.2 |
| 7,380,544 | B2 * | 6/2008 | Raduenz et al. | 123/568.12 |
| 7,617,679 | B2 * | 11/2009 | Kardos et al. | 60/605.2 |
| 2009/0223219 | A1 * | 9/2009 | Joergl et al. | 60/605.2 |

FOREIGN PATENT DOCUMENTS

| | | |
|---|---|---|
| DE | 44 14 429 | 6/1995 |
| DE | 197 34 801 | 2/1999 |
| DE | 197 50 588 | 5/1999 |

(Continued)

*Primary Examiner* — Willis Wolfe, Jr.
(74) *Attorney, Agent, or Firm* — Leydig, Voit & Mayer, LTD.

(57) ABSTRACT

A device for recycling and cooling exhaust gas of an internal combustion engine is disclosed, comprising a first exhaust-gas heat exchanger and a second exhaust-gas heat exchanger, wherein the first and second exhaust gas heat exchangers are combined in a structural unit and form a module.

29 Claims, 10 Drawing Sheets

FOREIGN PATENT DOCUMENTS

| | | |
|---|---|---|
| DE | 199 07 163 | 10/1999 |
| DE | 198 41 927 | 3/2000 |
| DE | 199 62 863 | 6/2001 |
| DE | 102 03 003 | 8/2003 |
| DE | 103 51 546 | 6/2004 |
| DE | 103 51 845 | 6/2005 |
| EP | 1 030 050 | 8/2000 |
| JP | 11-200955 | 7/1999 |
| JP | 2005-9406 | 1/2005 |
| WO | WO 2004/044412 | 5/2004 |
| WO | WO 2004/051069 | 6/2004 |

* cited by examiner

DEVICE FOR RECYCLING AND COOLING EXHAUST GAS FOR AN INTERNAL COMBUSTION ENGINE

BACKGROUND OF THE INVENTION

The invention relates to a device for recirculating and cooling exhaust gas of an internal combustion engine according to the preamble of claim 1 and also to an arrangement for recirculating and cooling exhaust gas according to the preamble of claim 10, which are each known through U.S. Pat. No. 6,244,256 B1.

Exhaust-gas recirculation (abbreviation: AGR), especially cooled exhaust-gas recirculation, is used in today's vehicles due to legal regulations, in order to reduce particulate and pollutant emissions, especially nitrous oxide emissions. Because requirements on exhaust-gas cleaning are becoming stricter, greater exhaust gas mass flows are necessary, which can be handled only conditionally with known AGR systems.

Known AGR systems are arranged on the high-pressure side of the internal combustion engine, as described in U.S. Pat. No. 6,244,256 B1 named above. The known AGR system has an exhaust-gas turbocharger for a diesel engine and an AGR line with an AGR valve, which is arranged between the engine and exhaust-gas turbine. The recirculated exhaust gas is cooled, preferably in two stages, i.e., in two exhaust-gas heat exchangers, which are each cooled by a separate coolant circuit and are constructed as high-temperature and low-temperature exhaust-gas coolers. The cooled, recirculated exhaust gas is combined with compressed and cooled charge air and fed to the intake tract of the engine.

Exhaust-gas heat exchangers, especially exhaust-gas coolers, are known in various embodiments: through DE 199 07 163 A1 of the applicant, a welded construction for an exhaust-gas heat exchanger became known, which is made from a bundle of exhaust-gas pipes, around which coolant flows on their outside. This coolant is removed from the cooling circuit of the internal combustion engine.

In many cases, exhaust-gas heat exchangers are also equipped with a bypass channel for the exhaust gas, i.e., for the case that cooling of the exhaust gas or, for heating purposes, heating of the coolant is not necessary or not advantageous. In DE 199 62 863 A1 of the applicant and in DE 102 03 003 A1, such exhaust-gas heat exchangers are disclosed with an integrated bypass, wherein in an inlet diffuser or in the outlet region of the exhaust-gas heat exchanger there is a bypass valve, preferably in the form of a bypass flap, which acts as a switch for the exhaust-gas flow and guides this flow either through the pipe bundle with coolant flowing around this bundle or through the bypass channel.

As is known by EP 1 030 050 A1, the bypass channel for the exhaust-gas heat exchanger can also be arranged separately, i.e., outside of the heat exchanger. In this known AGR system, the AGR valve is arranged, incidentally, in the return of the AGR line, i.e., behind the exhaust-gas cooler in the direction of the exhaust-gas flow.

Through DE 198 41 927 A1, a device for exhaust-gas recirculation became known with a valve device, in which a bypass channel with a bypass flap is integrated. The exhaust-gas heat exchanger has a bundle of U-shaped exhaust-gas pipes, which are cooled by a liquid coolant.

Through DE 197 50 588 A1, a device for exhaust-gas recirculation became known, in which an exhaust-gas heat exchanger with an exhaust-gas recirculation valve (AGR valve) is integrated to form a structural unit. Thus, a simplified and thus less expensive manufacture can be effected since individual parts can be eliminated.

A disadvantage in the known AGR systems is that these are made from a plurality of individual parts, which are produced separately and which are mounted individually, which increases costs. In addition, in the known AGR systems, it is disadvantageous that greater exhaust-gas flows cannot be recirculated since, due to the arrangement of the ASR system on the high-pressure side of the engine, the pressure difference between the exhaust gas side and the intake side of the engine are insufficient to discharge greater mass flows.

BRIEF SUMMARY OF THE INVENTION

The problem of the present invention is to construct a device for exhaust-gas recirculation of the type named above more easily and more economically. Another problem of the invention is to create an arrangement for exhaust-gas recirculation, which allows the recirculation and cooling of larger exhaust-gas mass flows.

This problem is first solved by the features of claim 1. According to the invention, a first and a second exhaust-gas heat exchanger are integrated to form a structural unit or module. Preferably, the two exhaust-gas heat exchangers are constructed as high-temperature and low-temperature exhaust-gas coolers, which are each cooled by a separate cooling circuit, preferably by the coolant circuit of the internal combustion engine and by a low-temperature cooling circuit. Both heat exchangers can be connected to each other to form a structural unit preferably mechanically or materially, i.e., through a joint connection, welding, or fusing. Here it is advantageous that such a module can be produced in a single production process and can be mounted as one unit in the vehicle, wherein the assembly of intermediate lines is also eliminated. This reduces the costs. A reduction of the installation space is further advantageous, because the components of the module are arranged compactly and without intermediate lines. The cooling of the exhaust gas is not limited to liquid cooling, air cooling, or liquid and air cooling are also possible.

In another construction of the invention, at least one of the two exhaust-gas coolers has a bypass channel, which can be either integrated or arranged separately. A bypass valve, which is arranged on the inlet or outlet side on the exhaust-gas cooler, is assigned to each bypass channel. These components, bypass and bypass valve, are thus also components of the module according to the invention.

In another advantageous construction of the invention, the AGR valve is also integrated into the module, wherein here an arrangement on the exhaust-gas inlet or exhaust-gas outlet side is also possible. The AGR valve can be constructed either as a pure stop valve or as a volume-controlling valve, especially a three-way valve, in order to regulate the recirculated mass flow.

In another advantageous construction of the invention, the high-temperature cooler has an inlet diffuser, in which a particulate filter and/or an oxidation-type catalytic converter is arranged, which is advantageous especially for exhaust-gas cleaning of diesel engines and prevents the build-up of soot in the exhaust-gas pipes of the cooler. These components are also integrated into the module and require no additional assembly.

In another advantageous construction, the exhaust gas is cooled in the first or second cooler with air, wherein the other cooling stage is cooled with coolant.

The problem of the invention is also solved by an arrangement for recirculating and cooling exhaust gas with the features of claim 10. According to the invention it is provided that the AGR line with at least one exhaust-gas cooler is arranged on the low-pressure side of the engine, i.e., on the discharge side of the exhaust-gas turbine and on the intake side of the compressor (turbocharger). Through this arrangement, larger exhaust-gas mass flows can be discharged, because the available pressure difference is defined by the compressor driven by the exhaust-gas turbine. The recirculated exhaust gas is thus fed together with the suctioned charge air to the compressor. Thus, the increasing requirements on the exhaust-gas cleaning, especially for larger exhaust-gas mass flows, like those that occur especially for commercial vehicles, can be taken into account.

According to an advantageous development of the invention, a module, which has the features of the device named above for exhaust-gas guidance, is arranged in the AER line on the low-pressure side. In particular, two exhaust-gas coolers are integrated to form one unit, optionally equipped with a bypass and a bypass valve and further provided with an AGR valve. Finally, this module also has a particulate filter and/or an oxidation-type catalytic converter for diesel exhaust gases. In this way, a high degree of integration of all of the AGR components on the low-pressure side is achieved, and in addition to the advantage of increased mass flow, a considerable cost advantage is achieved, which is realized both on the production side and also on the assembly side.

In another advantageous development of the invention, it is finally provided that the exhaust gas cooler or coolers can also be used as an auxiliary heating device, i.e., the heat discharged from the exhaust gases to the coolant can be fed to a heating circuit of the motor vehicle, by means of which additional heating of the passenger compartment is possible, for example, during the warm-up phase and for internal combustion engines with high thermal efficiency.

In another advantageous embodiment, the first cooler can be made from stainless steel, and the second cooler can be made from aluminum. The aluminum can be protected from corrosion. In this way, preferably in the first cooler, the high exhaust-gas temperature can be reduced, so that the inlet temperature into the second cooler corresponds to an operating temperature that is advantageous for aluminum. The first cooling stage can have a very small and compact construction. As an advantageous embodiment, the first cooling stage can be realized as a short cooling pipe, in which a cooling spiral is preferably inserted.

In another advantageous construction, the exhaust-gas turbine can be constructed as a multiple-stage turbine system, and the compressor can be constructed as a multiple-stage compressor system. Preferably, the multiple-stage turbine system is constructed as a two-stage turbine unit, and the multiple-stage compressor system is constructed as a two-stage compressor unit, so that the charging can be performed by means of two compressor stages. This two-stage charging advantageously allows a higher charging pressure of the charge air that can be mixed together from cooled exhaust gas and fresh air in various mixture ratios. For limiting the temperature, preferably between the first and the second compressor stage, there is an intermediate heat exchanger, so that the temperature of the second compressor stage can be limited. In addition, cooling of the exhaust gas/fresh air flow with an intermediate heat exchanger can advantageously increase the efficiency of the second compressor stage.

In another advantageous development of the invention, for the AGR valve integrated into the module, which can be located both on the exhaust-gas inlet and also on the exhaust-gas outlet side and which can be constructed either as simply a stop valve or as a volume-controlling valve, especially a three-way valve, in order to regulate the recirculated mass flow, the expansion of the exhaust gas can be performed in multiple stages, preferably two stages, and the compression of the exhaust gas/fresh air mixture can also be performed in multiple stages and preferably in two stages.

In another advantageous construction of the invention, the AGR valve and the bypass valve can be constructed in one structural unit as a multifunctional valve. Here, the turbine and the compressor can also preferably have a one-stage or multiple-stage, especially two-stage, construction.

In another advantageous development of the invention, a modular system is formed from the module (10, 18) and at least one other module, preferably several modules.

BRIEF DESCRIPTION OF THE SEVERAL VIEWS OF THE DRAWINGS

Embodiments of the invention are shown in the drawing and are described in more detail below. Shown are FIG. 1*a*, an AGR system with exhaust-gas cooler on the low-pressure side, FIG. 1*b*, an AGR system with exhaust-gas cooler on the low-pressure side and a two-stage turbine/compressor system with intermediate cooling, FIG. 2*a*, an AGR system with two-stage exhaust-gas cooling and exhaust-gas cooler module on the low-pressure side, wherein the AGR valve is arranged on the hot exhaust-gas side, i.e., in front of the two-stage exhaust-gas cooling, FIG. 2*b*, an AGR system with two-stage exhaust-gas cooling and exhaust-gas cooler module on the low-pressure side, wherein the AGR valve is arranged on the hot exhaust-gas side, i.e., in front of the two-stage exhaust-gas cooling, and the turbine/compressor system has two stages and is also provided intermediate cooling, FIG. 2*c*, an AGR system with two-stage exhaust-gas cooling and exhaust-gas cooler module on the low-pressure side, wherein the AGR valve is arranged on the cold exhaust-gas side, i.e., after the two-stage exhaust-gas cooling, FIG. 2*d*, an AGR system with two-stage exhaust-gas cooling and exhaust-gas cooler module on the low-pressure side, wherein the AGR valve is arranged on the cold exhaust-gas side, i.e., after the two-stage exhaust-gas cooling and the turbine/compressor system has two stages and also has available intermediate cooling, FIG. 3*a*, an AGR system with exhaust-gas cooler module and integrated AGR valve, as well as particulate filter and/or oxidation-type catalytic converter, FIG. 3*b*, an AGR system with exhaust-gas cooler module and integrated ASR valve, as well as particulate filter and/or oxidation-type catalytic converter, as well as a two-stage turbine/compressor system with intermediate cooling, FIG. 4*a*, an AGR system with exhaust-gas cooler module and integrated AGR valve, bypass valve, and also particulate filter and/or oxidation-type catalytic converter, wherein the AGR valve and the bypass valve are combined in one multifunctional valve to form one structural unit, and FIG. 4*b*, an AGR system with exhaust-gas cooler module and integrated ASR valve, bypass valve, as well as particulate filter and/or oxidation-type catalytic converter, wherein the AGR valve and the bypass valve are combined in one multifunctional valve to form one structural unit, as well as a two-stage turbine/compressor system with intermediate cooling.

DETAILED DESCRIPTION OF THE INVENTION

Figure 1A:
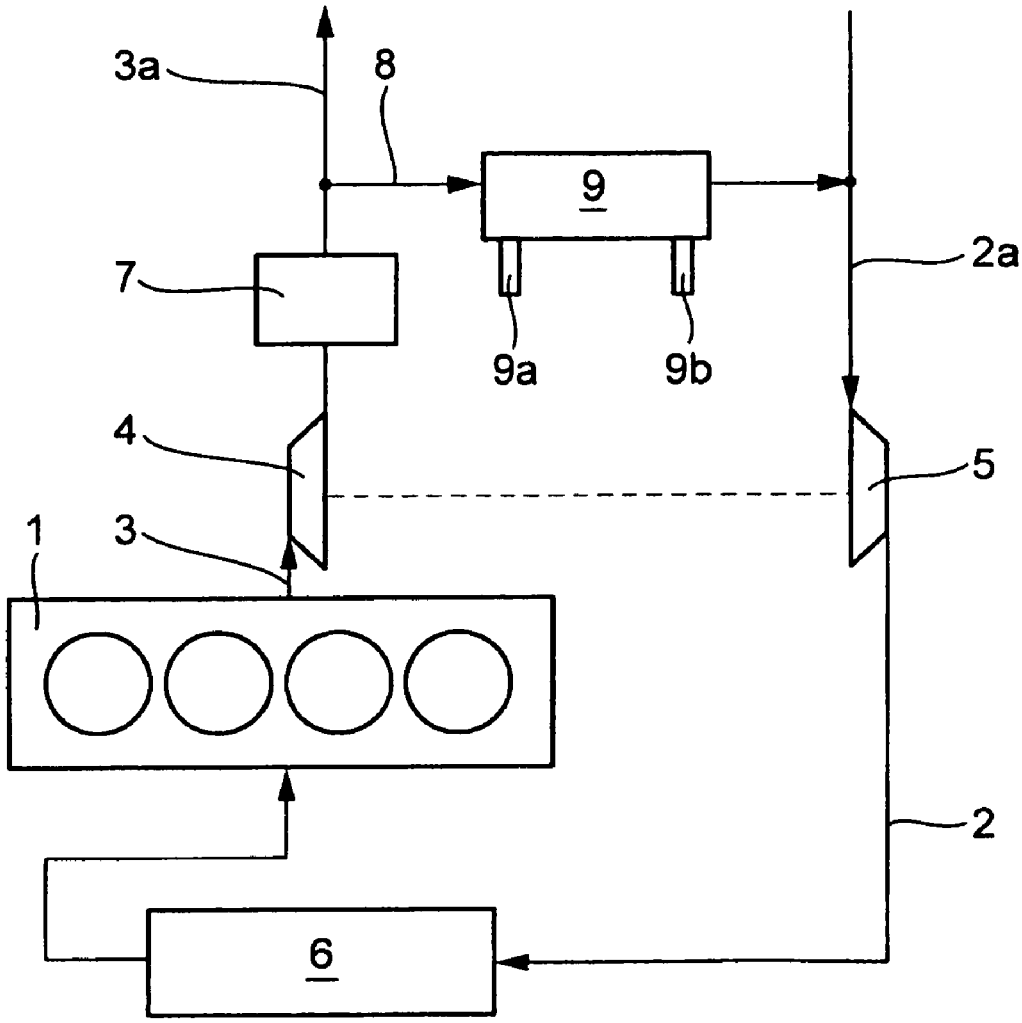

FIG. 1*a* shows an exhaust-gas recirculation system (AGR system) for a supercharged internal combustion engine 1 constructed as a diesel engine for a not-shown motor vehicle.

The diesel engine 1 has an intake line 2 and an exhaust-gas line 3, wherein an exhaust-gas turbine 4 is arranged in the exhaust-gas line 3 and a compressor 5 (so-called exhaust-gas turbocharger) driven by the exhaust-gas turbine 4 is arranged in the intake line 2. Between the compressor 5 and the intake tract of the engine 1 (not shown in more detail) there is a charge-air cooler 6, which is cooled, not shown, by a liquid coolant or by air. A particulate filter and an oxidation-type catalytic converter, shown by a rectangle 7, are arranged downstream of the exhaust-gas turbine 4. The region 3*a* of the exhaust-gas line 3 located downstream of the exhaust-gas turbine 4 and the section 2*a* of the intake line 2 located upstream of the compressor 5 are designated as the low-pressure side. An exhaust-gas recirculation line (AGR line) 8 and also an exhaust-gas cooler 9, which can be connected via two adapters 9*a*, 9*b* to a not-shown coolant circuit of the engine 1, can be arranged between the line sections 2*a*, 3*a*.

The function of the shown AGR system is as follows: fresh air is suctioned via the low-pressure section 2*a*, brought to an elevated pressure, the charge pressure, by the compressor 5, fed to the charge-air cooler 6 via the intake line 2, cooled there for the purpose of increasing the charging efficiency, and fed to the engine 1. The exhaust gases leaving the engine drive the exhaust-gas turbine 4, which drives, on its side, the compressor 5. Behind the exhaust-gas turbine 4, the diesel exhaust gases are cleaned by the particulate filter and the oxidation-type catalytic converter 7. Before the exhaust gases are released into free space, a partial flow is branched via the AGR line 8, cooled in the exhaust-gas cooler 9, and fed to the low-pressure section 2*a*, where the recirculated exhaust gases are mixed with the suctioned fresh air. The output or the pressure difference on the compressor 5 is thus the deciding factor for the amount of exhaust gas (mass flow) recirculated via the exhaust-gas cooler 9 and thus can be increased considerably, relative to a known AGR system on the high-pressure side, where only the pressure difference between the engine exhaust-gas side and the engine intake side is available for the discharge flow.

Figure 1B:
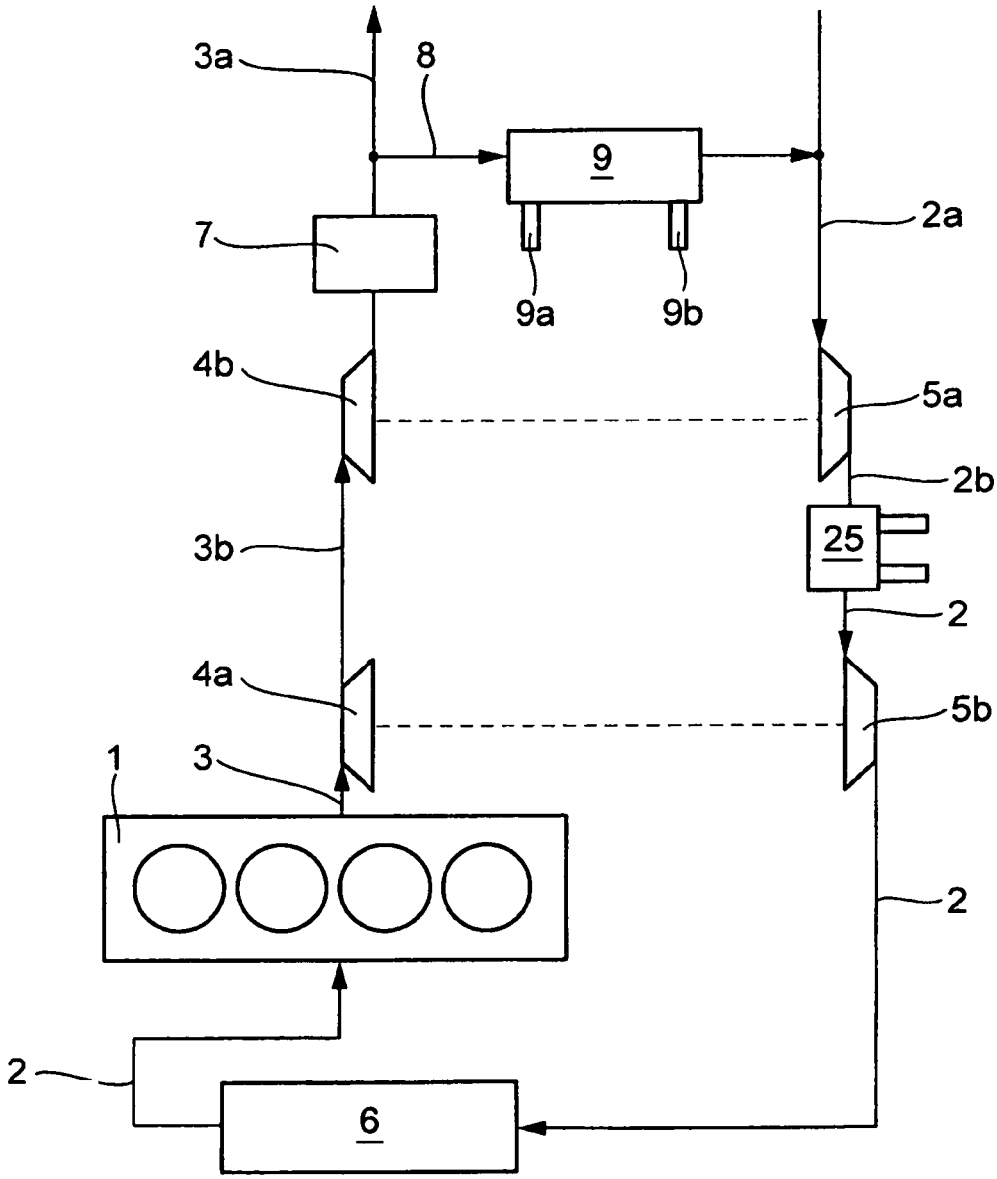

FIG. 1*b* shows an exhaust-gas recirculation system (AGR system) like that described in FIG. 1*a*. In contrast to FIG. 1*a*, the turbine (4) is constructed as a two-stage turbine system, and the compressor (5) is constructed as a two-stage compression system with intermediate cooling.

The function of the shown AGR system is the following; fresh air is suctioned via the low-pressure section 2*a*, brought to a higher pressure, the intermediate pressure, by the first compressor stage 5*a*, and fed to an intermediate heat exchanger 25 via an intermediate pressure section 2*b*. In the intermediate heat exchanger, the exhaust gas/air mixture is cooled for limiting the temperature and then brought to an elevated pressure, the charge pressure, relative to the intermediate pressure in a second compressor stage 5*b*, fed via the intake line 2 to the charge-air cooler 6, cooled there for the purpose of increasing the charging efficiency, and fed to the engine 1.

The exhaust gases leaving the engine drive a first exhaust-gas turbine 4*a*, which drives, on its side, the second compressor stage 5*b*. The expanded exhaust gas is fed via an exhaust-gas intermediate line 3*b* to a second exhaust-gas turbine 4*b*, which drives, on its side, the first compressor stage 5*a*. Behind the exhaust-gas turbine 4, the diesel exhaust gases are cleaned by the particulate filter and the oxidation-type catalytic converter 7. Before the exhaust gases are released into free space, a partial flow is branched via the AGR line 8, cooled in the exhaust-gas cooler 9, and fed to the low-pressure section 2*a*, where the recirculated exhaust gases are mixed with the suctioned fresh air.

Figure 2A:
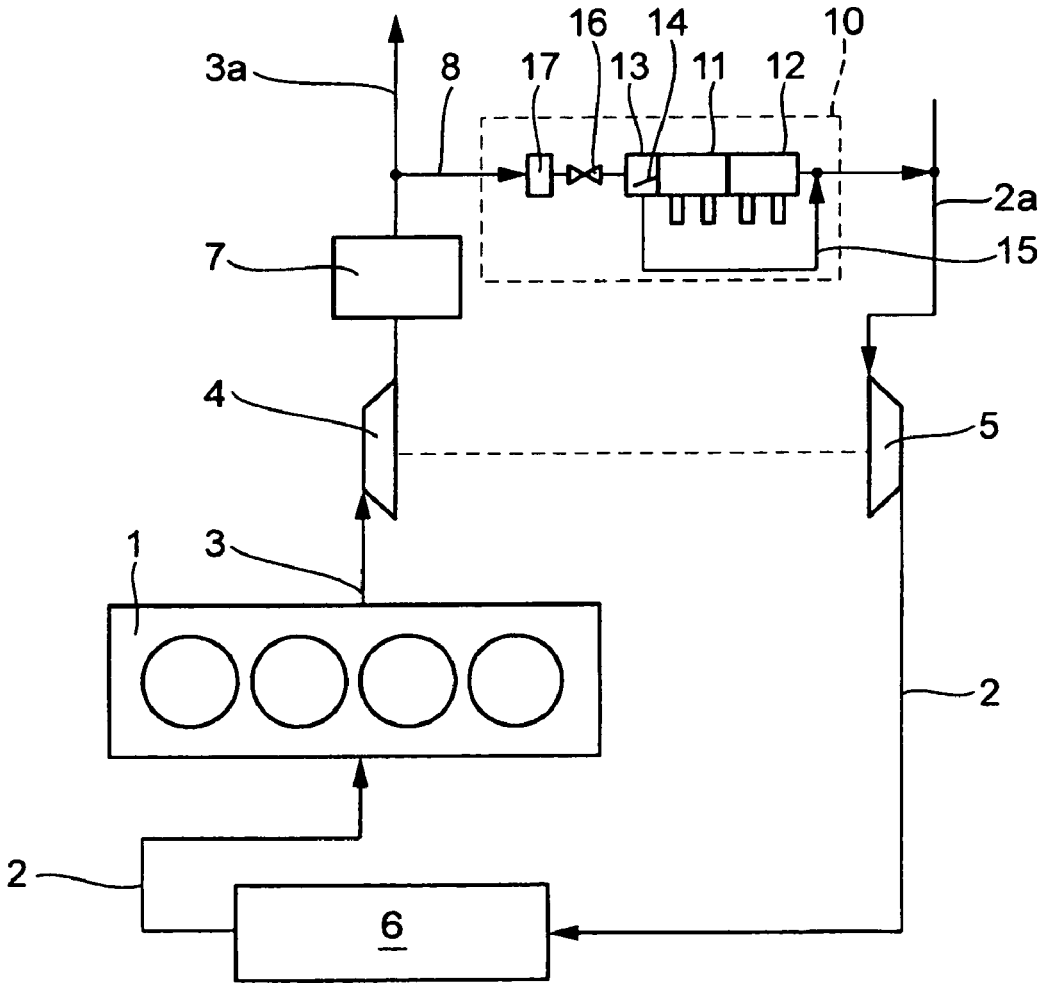

FIG. 2*a* shows another embodiment of the invention, i.e., an AGR system on the low-pressure side of the engine 1—for identical parts, identical reference numbers as in FIG. 1*a* are used. The AGR system according to FIG. 2*a* corresponds to that of FIG. 1*a* on the high-pressure side; on the low-pressure side, i.e., between the line sections 2*a*, 3*a* there is also an AGR line 8, which leads to a module 10, i.e., a structural unit, which is built from different components and which primarily comprises two exhaust-gas coolers 11, 12 that are connected one behind the other on the exhaust-gas side and that are rigidly connected mechanically, i.e., e.g., by a screw connection, or materially, i.e., by fusing or soldering. The exhaust-gas cooler 11 upstream on the exhaust-gas side is constructed as a high-temperature cooler and connected to the not-shown cooling circuit of the engine 1. The cooler 12 downstream on the exhaust-gas side is designed as a low-temperature cooler and connected to a not-shown low-temperature cooling circuit. Upstream of the high-temperature cooler 11 there is a valve device 13 with a bypass flap 14 and a bypass line 15 going around the exhaust-gas coolers 11, 12. This bypass line can be integrated into the exhaust-gas coolers 11, 12 or constructed as a separate line. The valve device 13 with bypass flap 14 can also be arranged downstream of the exhaust-gas coolers 11, 12 contrary to the illustration. In front of the valve device 13, i.e., here, upstream, there is an AGR valve 16 constructed as a stop valve, which is also integrated into the module 10, i.e., connected to the other parts to form one structural unit. Finally, in a not-shown inlet diffuser of the exhaust-gas cooler 11, that is, the high-temperature cooler, a particulate filter and/or an oxidation-type catalytic converter 17 can be provided, which is also structurally integrated. Thus, the components 11, 12, 13, 14, 15, 16, 17 are integrated to form one module 10, which can be produced and delivered as one unit and thus can also be mounted as one unit or assembly in the vehicle with relatively few manipulations. The module 10 is inserted into the AGR line 8 for assembly, the exhaust-gas coolers 11, 12 are connected to corresponding cooling circuits, and the valve device 13 and also the regulating valve 16 are connected to not-shown control devices. The module 10 can be mounted at a suitable position in the motor vehicle.

The function of the illustrated AGR system is similar to that in FIG. 1*a*, initially with the difference that here a two-stage cooling is performed on the exhaust-gas flow recirculated via the AGR line 8. If no cooling is necessary or advantageous, then both exhaust-gas coolers 11, 12 can be bypassed through the bypass line 15. The amount of recirculated exhaust gas 8 is regulated by means of the stop valve 16, wherein, in the simplest cases, a black-white control (open or closed) is sufficient. The particulate filter 17, which is also provided in addition to the particulate filter 7 in the exhaust-gas line 3*a*, prevents the build-up of soot in the not-shown exhaust-gas pipes of the two exhaust-gas coolers 1, 12. Because the exhaust-gas cooler module 10 is arranged on the low-pressure side (2*a*, 3*a*), an arbitrarily high pressure difference is available here for discharging the exhaust-gas flow at the compressor 5, which is advantageous due to the plurality of components in the AGR line 8 and high exhaust-gas mass flows.

Figure 2B:
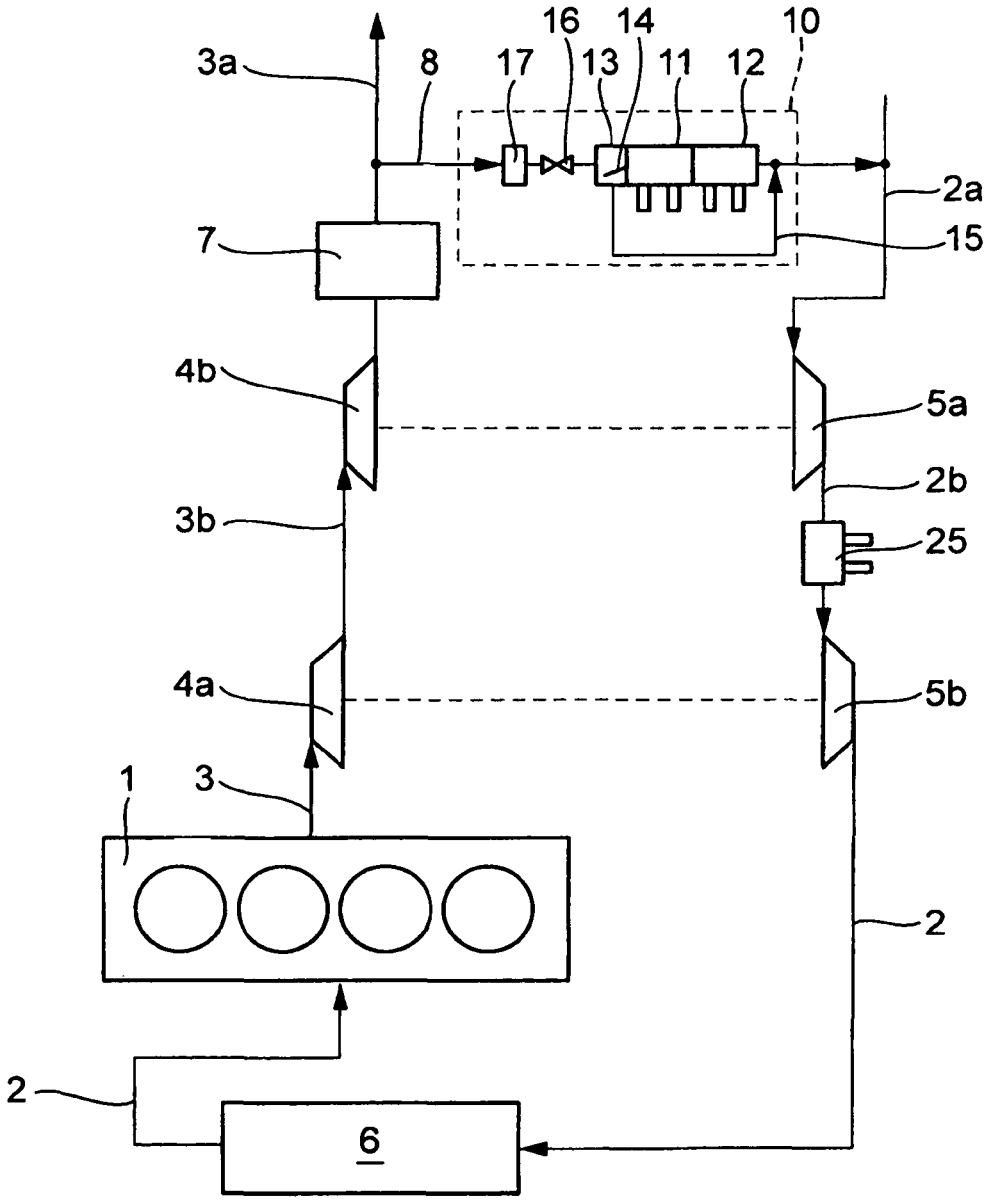

FIG. 2*b* shows another embodiment of the invention, i.e., an AGR system on the low-pressure side of the engine 1—for identical parts, identical reference numbers as in FIGS. 1*b* and 2*a* are used. In contrast to FIG. 2*a*, the turbine (4) is constructed as a two-stage turbine system, and the compressor (5) is constructed as a two-stage compression system with intermediate cooling, as described in FIG. 1*b*.

Figure 2C:
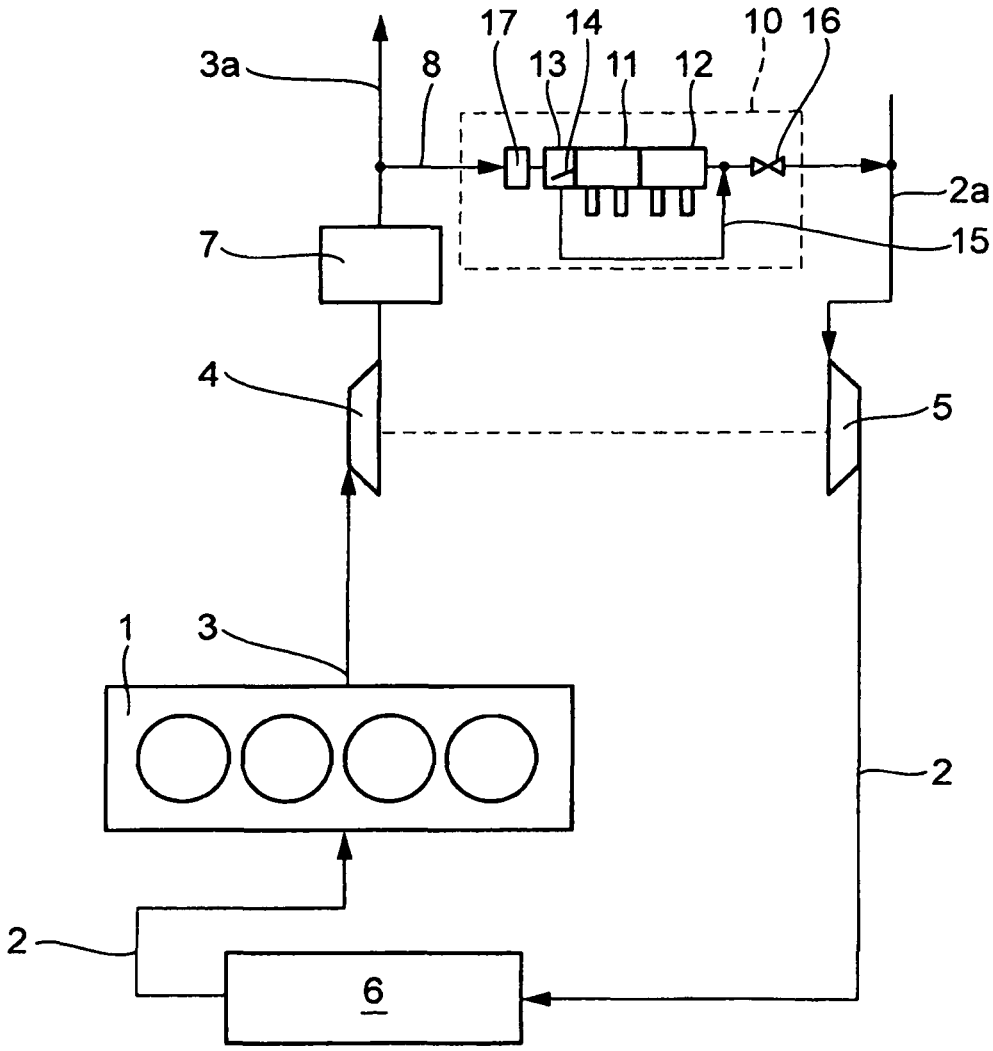

FIG. 2*c* shows another embodiment of the invention, i.e., an AGR system on the low-pressure side of the engine 1—for identical parts, identical reference numbers as in FIG. 2*a* are used. In contrast to FIG. 2*a*, the AGR valve 16, which is constructed as a stop valve and which is also integrated into the module 10, i.e., is connected to the other parts to form one structural unit, is arranged downstream of the exhaust-gas coolers 11, 12 and the opening position of the bypass channel 15.

Figure 2D:
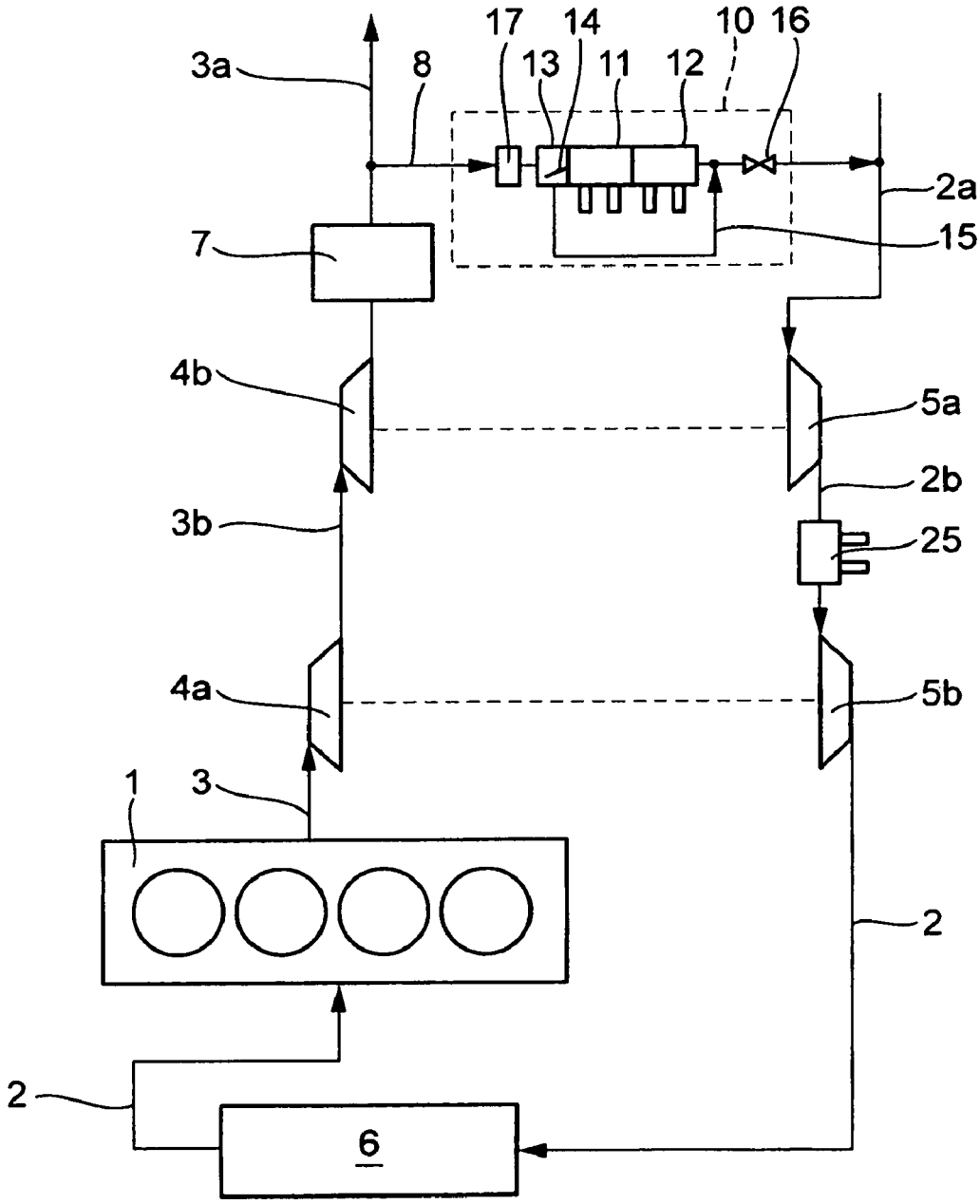

FIG. 2*d* shows another embodiment of the invention, i.e., an AGR system on the low-pressure side of the engine 1—for identical parts, identical reference numbers as in FIGS. 2*a* and 2*c* are used. In contrast to FIG. 2*c*, the turbine (4) is constructed as a two-stage turbine system, and the compressor (5) is constructed as a two-stage compression system with intermediate cooling, as described in FIG. 1*b*.

Figure 3A:
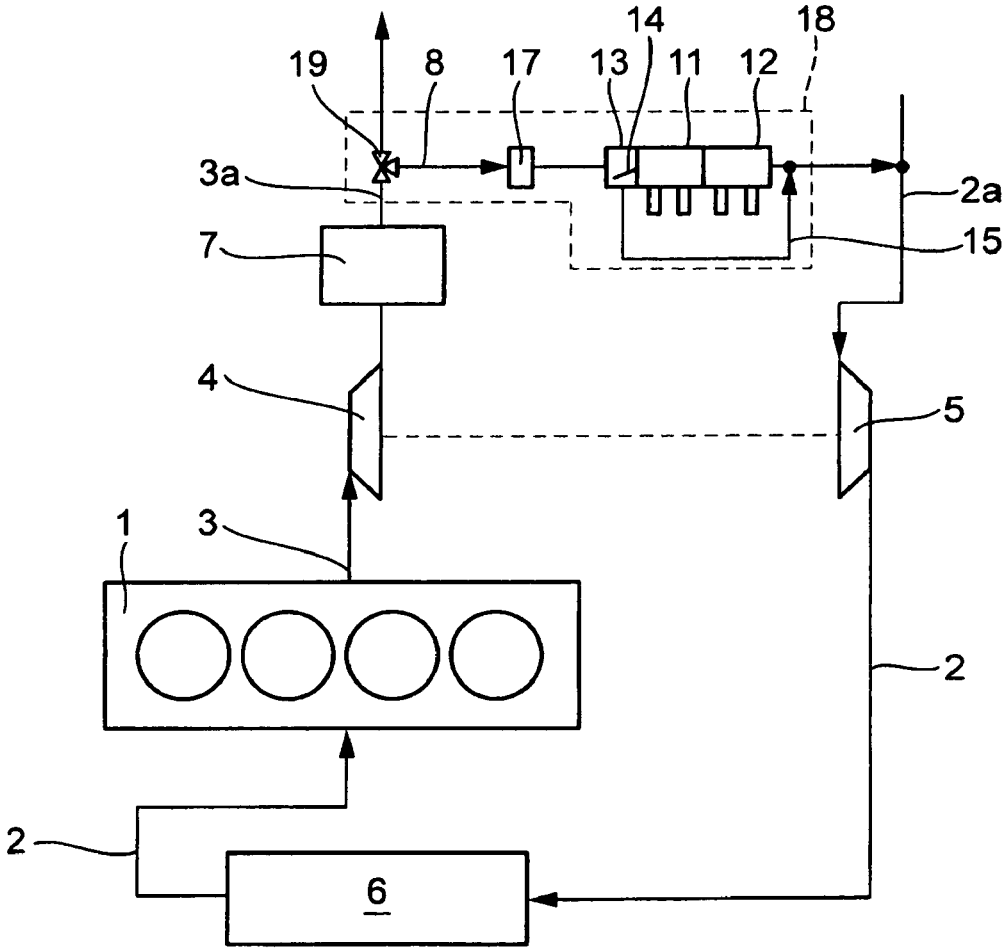

FIG. 3*a* shows another embodiment of the invention for an AGR system on the low-pressure side of the engine 1, wherein, in turn, identical reference numbers are used for identical parts. On the low-pressure side, i.e., between the intake line section 2*a* and the exhaust-gas line section 3*a* there is an exhaust-gas recirculation line 8, which is integrated to a large extent in a module 18. The module 18 also has, like the module 10 in FIG. 2*a*, the exhaust-gas coolers 11, 12, the valve device 13 with bypass flap 14, and also bypass channel 15, and further includes the particulate filter and/or the oxidation-type catalytic converter 17. Deviating from the embodiment according to FIG. 2 is a volume-controlling valve 19 (AGR valve), which is constructed as a three-way valve and which is arranged at the branching position of the exhaust-gas line 3*a* and AGR line 8. The regulating valve 19 can adjust the percentage of exhaust gas that is removed from the total exhaust gas flow. In this way, a more precise regulation of the recirculated exhaust gas mass flow is possible. Incidentally, the functions of module 18 are equal to those of module 10 in FIG. 2*a*.

The illustrations of the modules 10, 18 and their components are schematic, i.e., many structural variants are possible. This applies initially for the exhaust-gas coolers 11, 12, which can be constructed as tube-bundle heat exchangers with straight or U-shaped pipes with circular, rectangular, or other cross sections. Likewise, different variants in terms of the valve closing element, the associated actuator, and the bypass channel (integrated or separate) are possible for the bypass device, What is important is that the mentioned components are combined to a large extent into a transportable, preassembled structural unit, which can be used and connected in the overall AGR system to the vehicle with low assembly and time expense. This finally also results in a decisive installation-space advantage, because the components form a compact multifunctional unit.

Figure 3B:
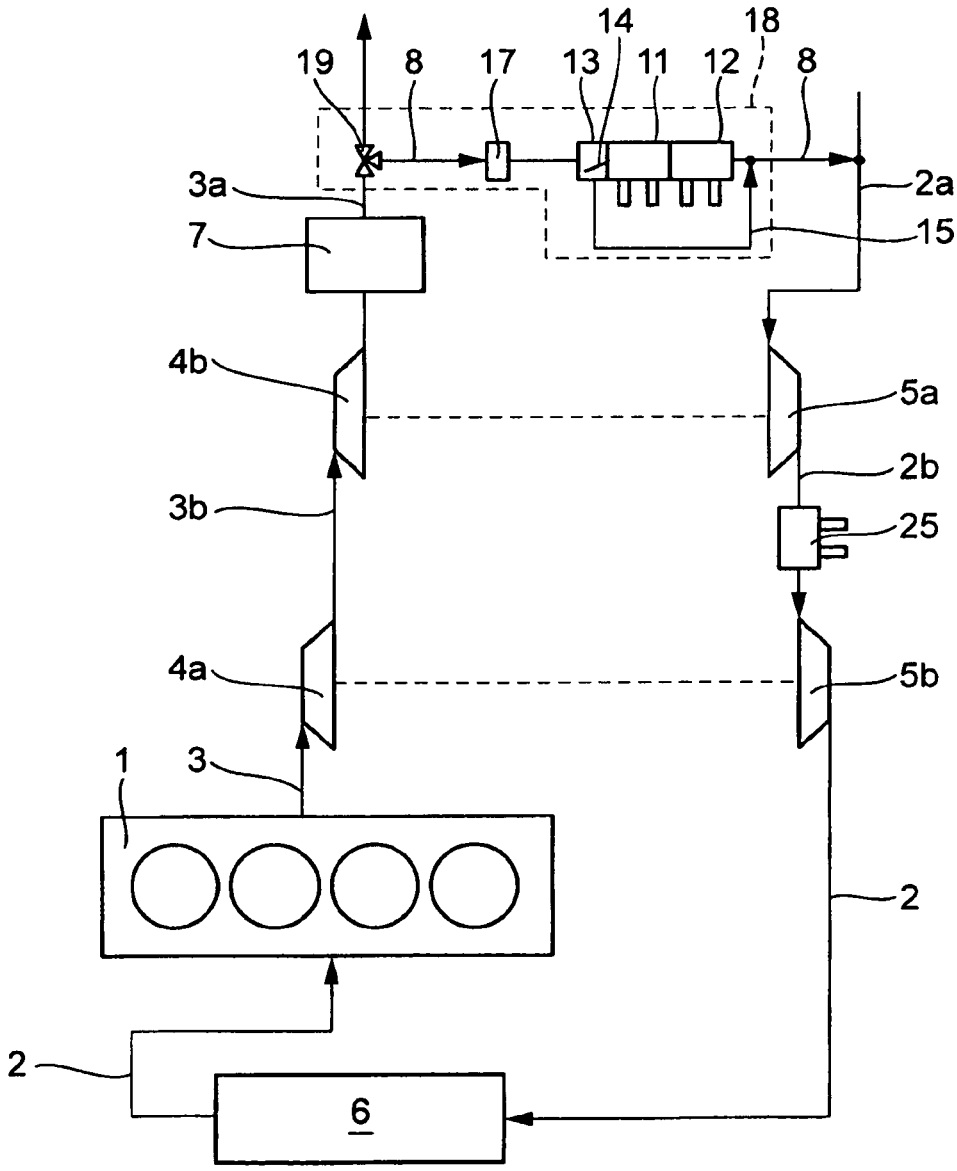

FIG. 3*b* shows another embodiment of the invention for an AGR system on the low-pressure side of the engine 1, wherein, in turn, identical reference number are used for identical parts as in FIG. 3*a*. In contrast to FIG. 3*a*, the turbine (4) is constructed as a two-stage turbine system and the compressor (5) is constructed as a compression system with intermediate cooling, as described in FIG. 1*b*.

Figure 4A:
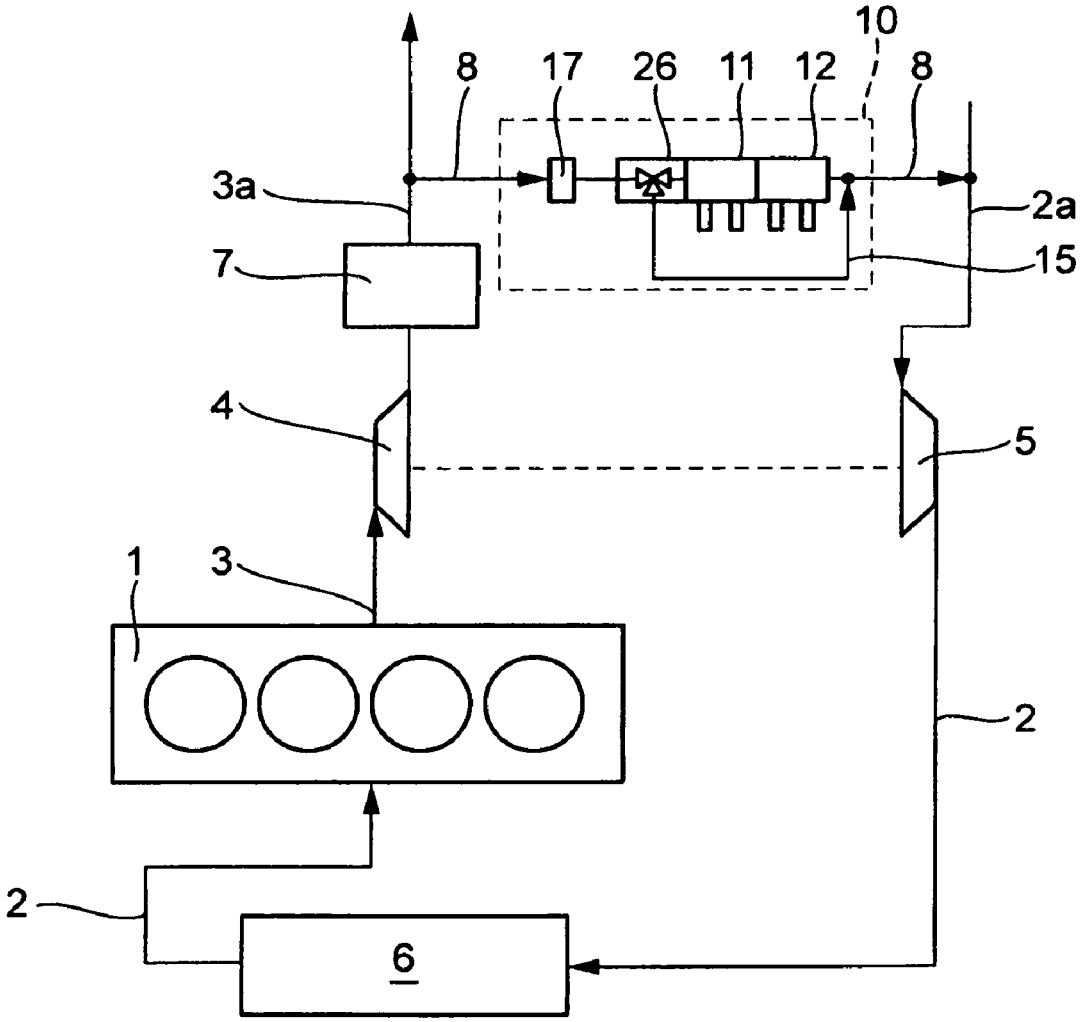

FIG. 4*a* shows another embodiment of the invention for an AGR system on the low-pressure side of the engine 1, wherein, in turn, identical reference symbols are used for identical parts.

In contrast to the preceding embodiments, the AGR valve 19, the valve device 13, and the bypass flap 14 are combined into one structural unit and form a multifunctional valve 26.

Figure 4B:
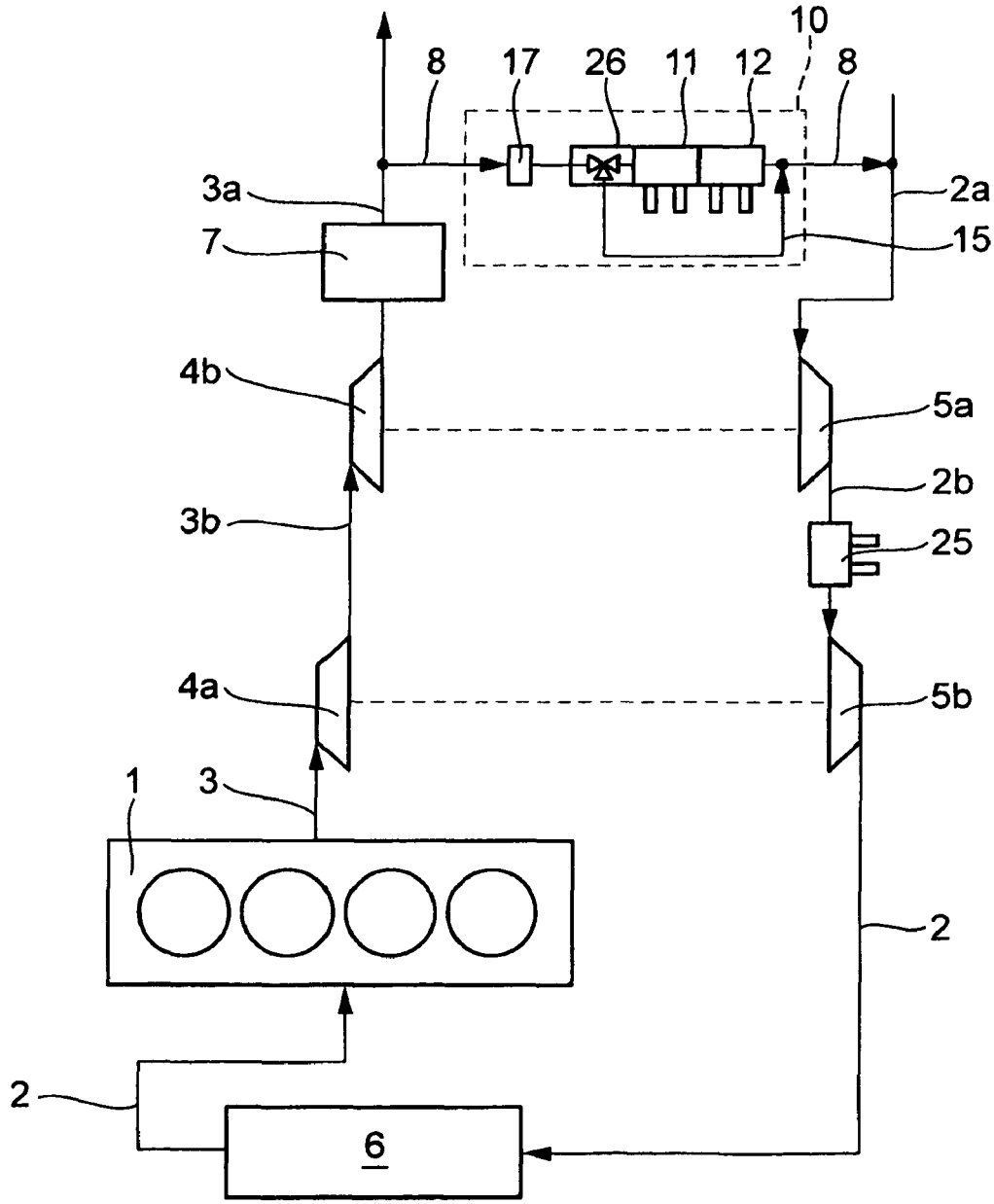

FIG. 4*b* shows another embodiment of the invention for an AGR system on the low-pressure side of the engine 1, wherein, in turn, identical reference numbers are used for identical parts.

In contrast to FIG. 4*a*, the turbine (4) is constructed as a two-stage turbine system and the compressor (5) is constructed as a two-stage compression system with intermediate cooling, as described in FIG. 1*b*.

The invention claimed is:

1. A device for recirculating and cooling exhaust gas of an internal combustion engine, in a motor vehicle with an exhaust-gas recirculation (AGR) line, and an exhaust-gas recirculation (AGR) valve, the device comprising a first exhaust-gas heat exchanger, a second exhaust-gas heat exchanger, and the AGR valve, wherein the first exhaust-gas heat exchanger, the second exhaust-gas heat exchanger, and the AGR valve, are combined into one structural unit and form one module.

2. The device according to claim 1, wherein the motor vehicle has an exhaust-gas side and the first and second exhaust-gas heat exchangers are connected one behind the other on the exhaust-gas side and one exhaust-gas heat exchanger is a high-temperature cooler and the other exhaust-gas heat exchanger is a low-temperature cooler.

3. The device according to claim 1, wherein one exhaust-gas heat exchanger is a high temperature cooler, and the other exhaust-gas exchanger is a lower temperature cooler, and the high-temperature cooler and the low-temperature cooler are connected to each other.

4. The device according to claim 1, wherein the first and second exhaust-gas heat exchangers are operated with parallel flow or cross flow.

5. The device according to claim 1, wherein the AGR valve is arranged in front of the first exhaust-gas heat exchanger and/or the second exhaust-gas heat exchanger.

6. The device according to claim 1, wherein the AGR valve is arranged after the first exhaust-gas heat exchanger and/or the second exhaust-gas heat exchanger.

7. The device according to claim 1, further comprising a particulate filter, the filter forming one structural unit with the AGR valve.

8. The device according to claim 1, wherein the AGR valve is constructed as a stop valve or as a volume-controlling valve.

9. The device according to claim 1, comprising a multifunctional valve including the AGR valve and a bypass valve.

10. The device according to claim 1, wherein one exhaust-gas heat exchanger is a high temperature cooler, and the other exhaust-gas heat exchanger is a low temperature cooler, and the high-temperature cooler has an inlet diffuser in which a particulate filter and/or an oxidation-type catalytic converter are arranged.

11. The device according to claim 1, further comprising a first compressor stage and at least one other compressor stage.

12. The device according to claim 1, wherein one exhaust-gas heat exchanger is a high temperature cooler, and the other exhaust-gas heat exchanger is a low temperature cooler, and the high-temperature cooler is made from a different material than the low-temperature cooler.

13. The device according to claim 12, wherein the high-temperature cooler is made from a corrosion-resistant material, and the low-temperature cooler is made from a material, which is protected from corrosion, or is corrosion resistant.

14. The device according to claim 1, wherein one exhaust-gas exchanger is a high temperature cooler, and the other exhaust-gas heat exchanger is a low temperature cooler, and the high-temperature cooler and/or the low-temperature cooler has a bypass channel for exhaust gas.

15. The device according to claim 14, wherein a bypass valve, through which the exhaust-gas flow can be guided through the high temperature cooler and/or low temperature cooler or through the bypass channel, is assigned to the bypass channel.

16. The device according to claim 1, further comprising a first exhaust-gas turbine and at least one second exhaust-gas turbine.

17. The device according to claim 11, further comprising at least one intermediate heat exchanger, which is arranged on the downstream side of the first compressor stage and on the inflow side of the second compressor stage.

18. The device according to claim 11, further comprising a first exhaust-gas turbine and a second exhaust-gas turbine, wherein the first exhaust-gas turbine is coupled to the second compressor stage and the second exhaust-gas turbine is coupled to the first compressor stage.

19. The device according to claim 1, wherein the high-temperature cooler can be cooled by a first cooling circuit, and the low-temperature cooler can be cooled by a second cooling circuit.

20. The device according to claim 19, wherein a cooling agent of the first cooling circuit differs from a cooling agent of the second cooling circuit.

21. The device according to claim 20, wherein the cooling agent of the first cooling circuit is gaseous and the cooling agent of the second cooling circuit is liquid, or vice versa.

22. The device according to claim 20, wherein the cooling agent of the first cooling circuit is air and the cooling agent of the second cooling circuit is a coolant, or vice versa.

23. A modular system, comprising at least two modules wherein at least one module comprises first and second exhaust-gas heat exchangers and an exhaust-gas recirculation valve combined into one structural unit.

24. An arrangement for recirculating and cooling exhaust gas of an internal combustion engine comprising an intake line, a low pressure intake section, an exhaust-gas line, a low pressure exhaust section, and an AGR line leading from the exhaust-gas line to the intake line, an exhaust-gas turbine arranged in the exhaust-gas line, a compressor and a charge-air cooler arranged in the intake line, and an AGR valve and first and second exhaust-gas heat exchangers arranged in the AGR line, wherein the AGR line and the first and second exhaust-gas heat exchangers are arranged in communication with the low-pressure intake section and the low-pressure exhaust section of the internal combustion engine, wherein the AGR valve and the first and second exhaust-gas heat exchangers are combined into one structural unit and form one module, wherein the exhaust gas can be removed from the exhaust-gas line downstream of the exhaust-gas turbine, can be supplied to the one or more exhaust-gas heat exchangers, and can be fed into the intake line upstream of the compressor.

25. The arrangement according to claim 24, wherein the one or more exhaust-gas heat exchangers are part of a module.

26. The arrangement according to claim 25, further comprising an exhaust gas recirculation valve, and wherein the module comprises a first exhaust-gas heat exchanger and a second exhaust-gas heat exchanger combined into one structural unit.

27. The arrangement according to claim 24, comprising at least one first compressor stage, and at least one first exhaust-gas turbine.

28. The arrangement according to claim 27, further comprising a second compressor stage, the second compressor stage having an inflow side.

29. The arrangement according to claim 28, further comprising at least one intermediate heat exchanger, which is located downstream of the first compressor stage and on the inflow side of the second compressor stage.

* * * * *